US005314237A

United States Patent [19]

Koepke et al.

[11] Patent Number: 5,314,237

[45] Date of Patent: May 24, 1994

[54] RECLINING CHAIR

[75] Inventors: Marcus C. Koepke; Earl H. Koepke, both of Sturgis, Mich.

[73] Assignee: Kimball International Marketing, Inc., Jasper, Ind.

[21] Appl. No.: 834,585

[22] Filed: Feb. 12, 1992

[51] Int. Cl.[5] ..... A47C 1/024

[52] U.S. Cl. ..... 297/318; 297/323; 297/322

[58] Field of Search ..... 297/317, 318, 322, 323, 297/301

[56] References Cited

U.S. PATENT DOCUMENTS

| | | | |
|---|---|---|---|
| 809,944 | 1/1906 | Hanger | 297/318 |
| 2,473,895 | 6/1949 | Mednick | 297/318 |
| 2,611,420 | 9/1952 | Diehl | 297/318 |
| 3,806,192 | 4/1974 | Ohlrogge et al. | 297/318 |
| 4,004,763 | 1/1977 | Bunnell, III et al. | 297/318 |
| 4,429,917 | 2/1984 | Diffrient | 297/322 |

FOREIGN PATENT DOCUMENTS

| | | | |
|---|---|---|---|
| 0096273 | 12/1983 | European Pat. Off. | 297/317 |
| 2740697 | 3/1979 | Fed. Rep. of Germany | 297/318 |
| 580900 | 8/1958 | Italy | 297/317 |

*Primary Examiner*—Peter M. Cuomo
*Assistant Examiner*—Darnell M. Boucher
*Attorney, Agent, or Firm*—Thomas J. Dodd

[57] ABSTRACT

A reclining chair which includes a base, frame supports, and pivotable seat and back supports. The seat and back supports are pivotally connected for correlative movement, and the seat support is operably connected to an inclined ramp which raises the vertical height of the seat support during reclining.

9 Claims, 4 Drawing Sheets

RECLINING CHAIR

FIELD OF THE INVENTION

This invention relates to reclining chairs.

BACKGROUND OF THE INVENTION

Reclining chairs have been popular for over a century. Most of these chairs include a back support which is pivotally connected to the chair frame or base for movement between various positions relative to the seat support.

Some reclining chairs have also included a pivotal connection between the seat support and the back support which allows correlative movement between the two supports. A few of these chairs have included inclined ramps attached to the chair frame to allow for angular changes in the seat support relative to the floor.

U.S. Pat. No. 860,729 is typical of these ramp-type reclining chairs. As disclosed in the '729 patent, the rectangular seat support rides up inclined ramp B and roller C as the back support G is moved towards its multiple reclined positions. The concept in the '729 patent was to change the angle of inclination of the seat relative to the floor in order to compensate for the movement of the back support. Other U.S. patents which teach this basic concept are Nos. 728,141; 2,016,183; 2,098,623; 2,508,598; 3,947,06; 4,768,829; and Italian Patent 566,544. In each of these patents, the objective was to raise the forwardmost portion of the seat support to maintain a consistent angle between the seat support and back support.

The prior art chairs identified above did not address the critical problem of eye level. Typically, when one of the prior chairs was shifted into a reclined position, the change in angle of the back support caused the user's eye level to be lowered. The lowering of a user's eye level can be especially annoying when the chair is used in several environments, such as theaters, offices, and vehicles to name a few.

The prior art chairs identified above also did not address the mechanical balance of the chair to allow for the chair's tilt action tension to automatically adjust to all variations of a user's weight. Typically, when one of the prior chairs was shifted into the reclined position it was unbalanced until it reached its full reclined position or it was necessary to lock the chair in various tilting degrees. The unbalanced design of these chairs is annoying for users of different body weight especially in offices, vehicles, and theaters where chairs are used by so many different users daily.

SUMMARY OF THE INVENTION

The reclining chair of this invention achieves a mechanical balance to allow for the chair's tilt action tension to automatically adjust to all variations of users weight. This is achieved by area specific locations of the pivots, ramps and rollers of this chair which respond to each individual user's weight as the force to overcome a vertical position into a reclined position. Because each person is utilizing the invented balanced chair mechanism to overcome their own specific weight the chair will recline with the same level of difficulty for all users (heavy and light in weight). This balance also allows all users to recline to any degree of rearward tilt and maintain that degree of tilt without the use of locking mechanisms.

The reclining chair of this invention includes a ramp in combination with a roller arm which automatically adjusts the vertical height of the seat support in response to the position of the back support. The seal and back support movement is controlled by the shifting of the user's weight and allows the user to maintain a substantially constant vertical eye level, as well as maintain a proper angle of inclination between the seat and back supports to provide maximum lumbar support for the user.

The chair may include one or more ramps, rollers, and roller arms to facilitate movement of the seat support. The ramp preferably has a curved lower surface which allows for gradual inclination of the seat support forward and rear portions to ensure comfort and the constant vertical eye level are maintained.

It is an object of this invention to provide for a reclining chair which automatically raises the seat support in response to reclining of the back support, so that consistent vertical eye level is maintained.

Another object of this invention is to provide for a reclining chair which provides for proper lumbar support in all chair positions.

Another object is to provide a reclining chair which is reclined or uprighted in response to user weight shifting.

Another object is to provide for a reclining chair which is economical, easy to maintain, and can be adapted for use in various environments.

Another object of this invention is to provide for a balanced reclining chair that may be shifted from an upright position to a reclined position and all degrees between with the same level of difficulty for different weight users.

Other objects will become apparent upon reading of the following description.

BRIEF DESCRIPTION OF THE DRAWINGS

A preferred embodiment has been depicted for illustrative purposes only wherein.

DESCRIPTION OF THE PREFERRED EMBODIMENT

Figure 1:
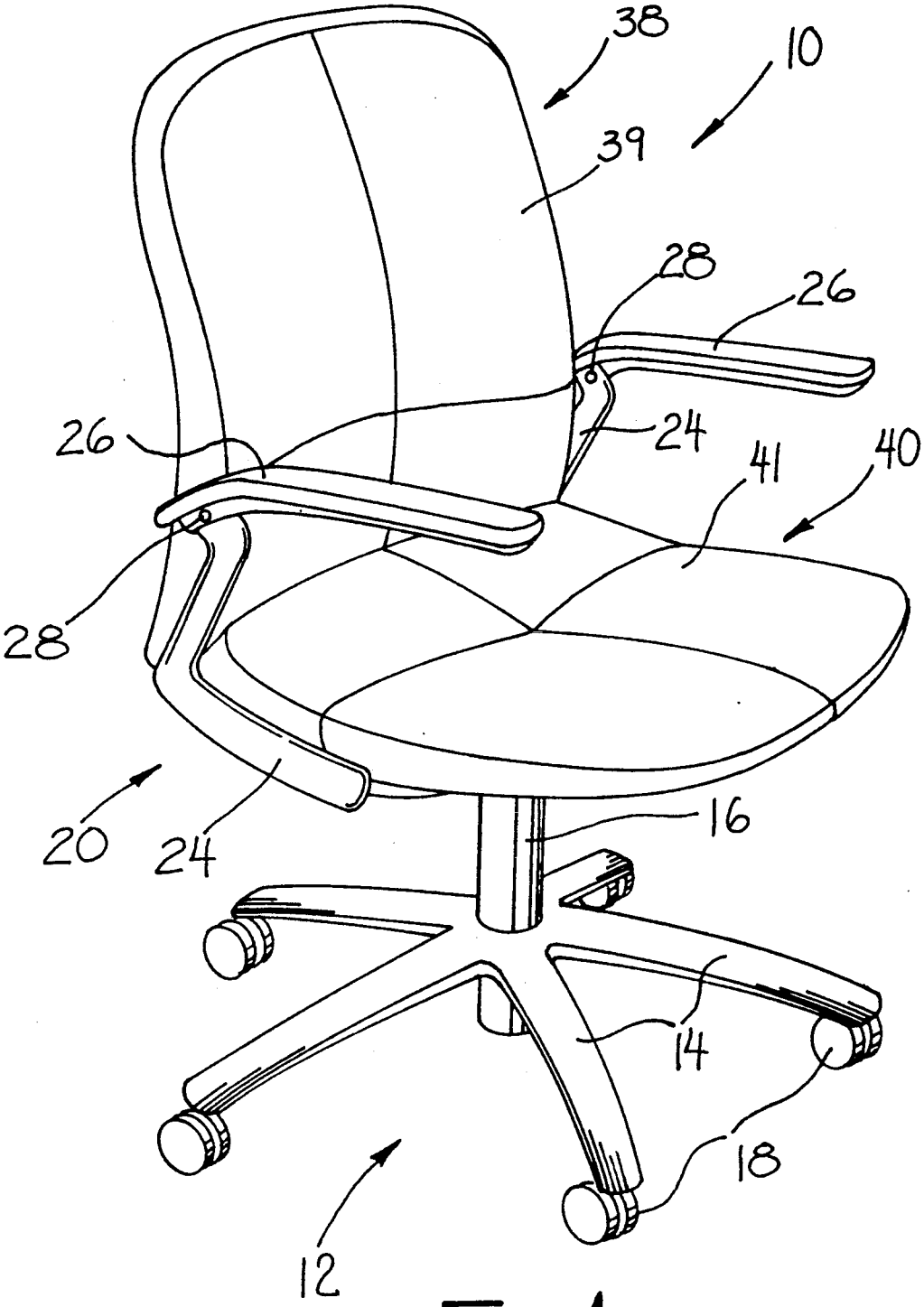
FIG. 1 is a perspective view of the reclining chair of this invention in an upright position.

The preferred embodiment herein described is not intended to be exhaustive or to limit the invention to the precise form disclosed. It is chosen and described to explain the principles of the invention and its application and practical use to enable others skilled in the art to utilize its teachings.

Referring now to the drawings, reference numeral 10 generally designates the reclining chair of this invention. Chair 10 includes a base frame 12 which is of a conventional construction. Base 12 may vary dependent upon the intended use of chair 10. As shown, base 12 includes a plurality of legs 14 connected to a tubular support 16. Casters 18 are connected to legs 14 to form a swivel base for a typical office chair. By varying the construction of base 12, chair 10 may be adapted for numerous other uses, including but limited to, vehicle seats, theater seats, home furniture, and others.

Chair supports 20 are connected to swivel bearing 22 fastened to tubular support 16. Chair supports 20 each include tubular frame 24 and arm rest 26 as shown. Each arm rest 26 is connected to frame 24 by a rod 28 which may allow the arm rest to be pivoted between up and down positions.

A roller arm 30 is fixedly connected, as by welding, to swivel bearing 22. Roller arm 80 extends forwardly of swivel bearing 22. Rollers 34 are connected to ramp 30 as by axle 36 which extends through the ramp and allows for free rotation of the rollers relative to the ramp.

A back support 88 is pivotally connected to chair support frame 24 by rods 28 which extend into the back support. A seat support 40 is pivotally connected to back support 38 by one or more pivot pins 42 as shown. Back support 88 and seat support 40 each typically include a frame (not shown) and a cushion member 89, 41, respectively, attached to the frame.

Figure 2:
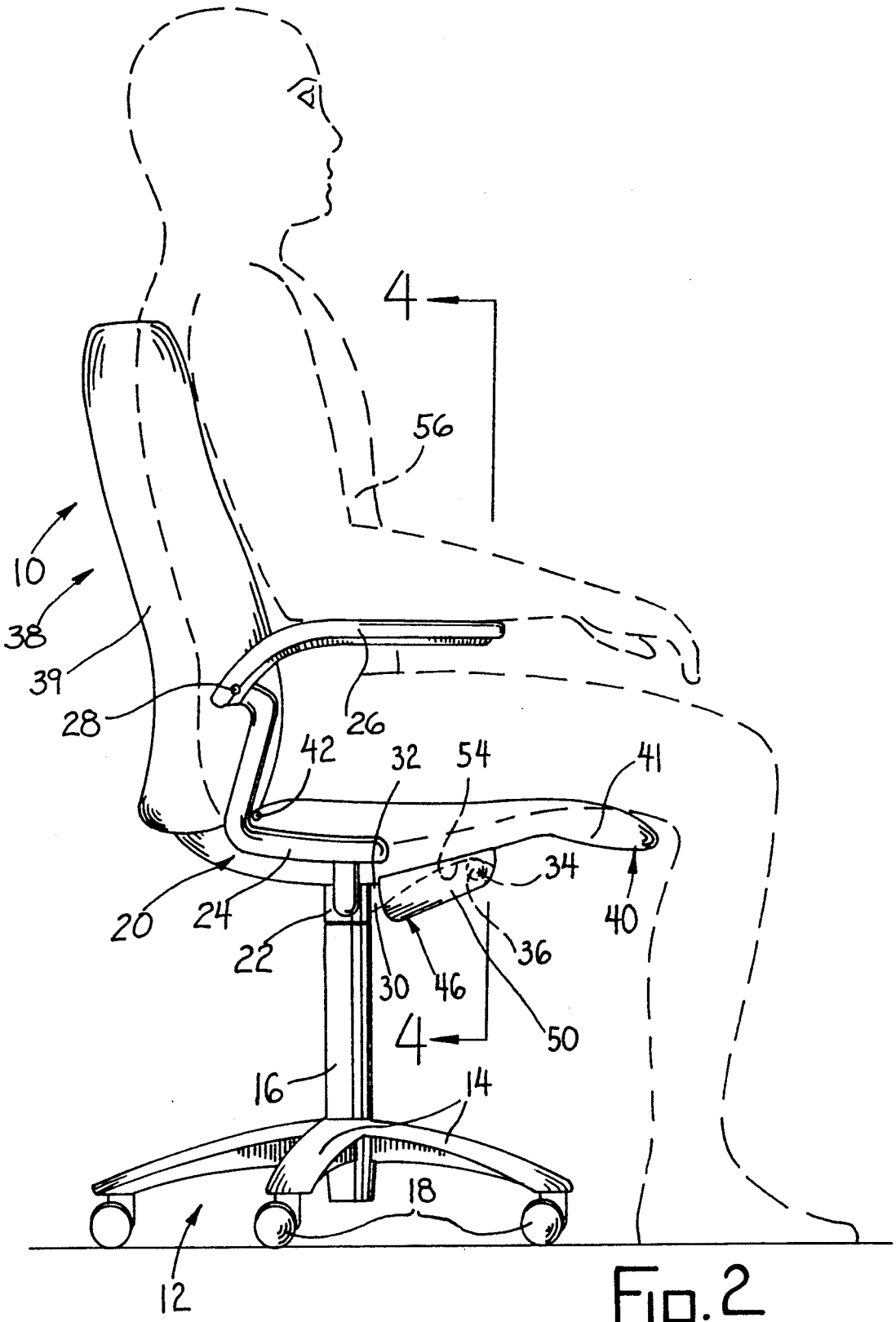
FIG. 2 is a side elevation view of the chair of FIG. 1.

A ramp assembly 46 is connected to the lower surface of seat support 40. Center plate 48, as shown, can be designed many different ways but for the purpose of illustration center plate 48 is attached to the bottom of seat support 40. Center plate 48 has incorporated into the design on the lower surface a ramp 54 which is sloped downward toward the rear of the chair seat 40. Ramp 54 can be straight or curved. Roller 84 rides on Ramp 54 as the back and seat supports 88, 40 are shifted between their upright position (FIG. 2) and the reclined position (FIG. 8). Center plate 48 also has downturned lips 50, 52 designed as tracks to keep roller on ramp 54. Cover member 47 which has lower lips 49 prevents seat support 40 from being lifted upwardly from its front edge. Cover member 47 encloses roller 84, roller arm 30 and ramp assembly 46.

Figure 3:
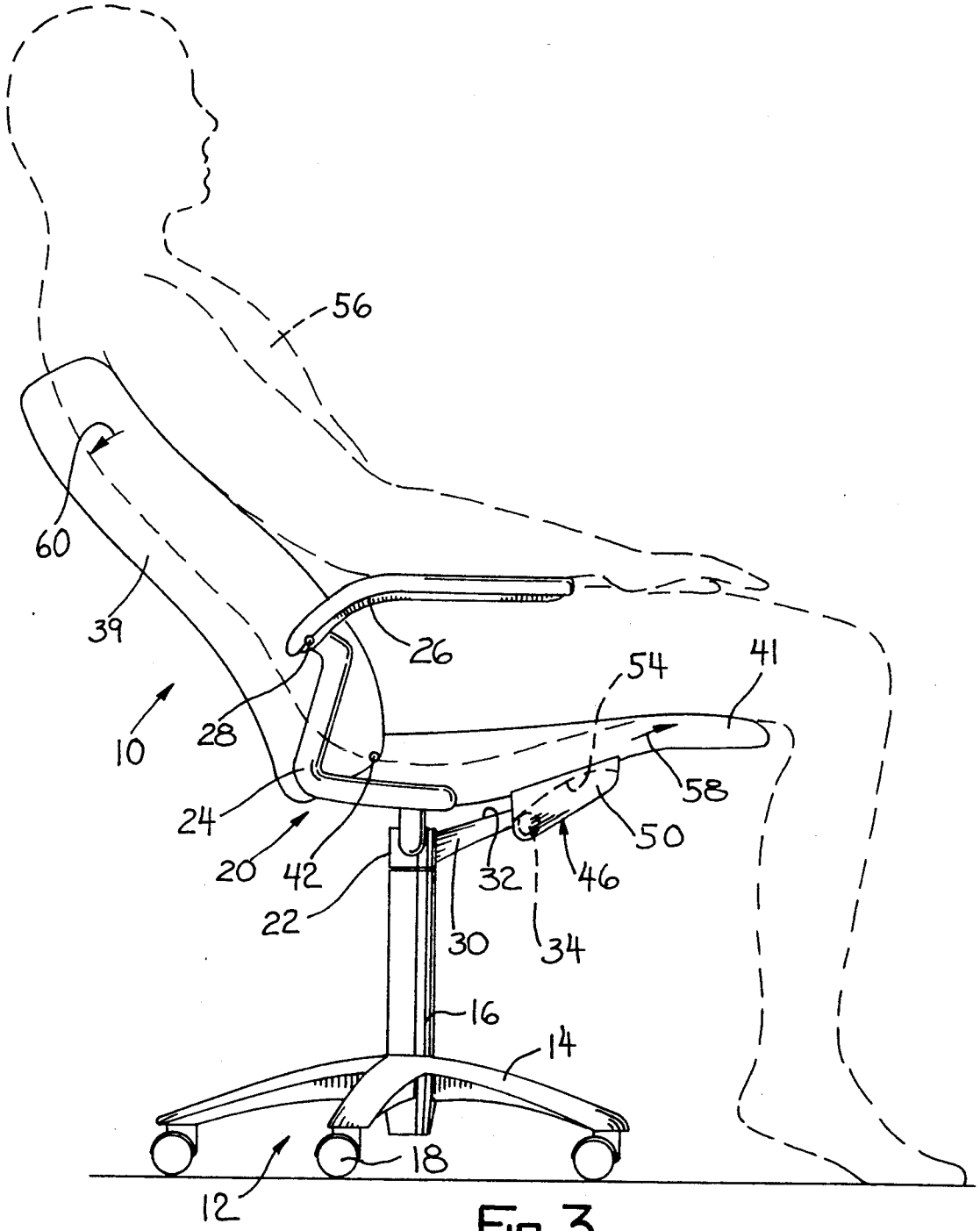
FIG. 3 is a side elevation view of the chair in a reclined position.
Figure 4:
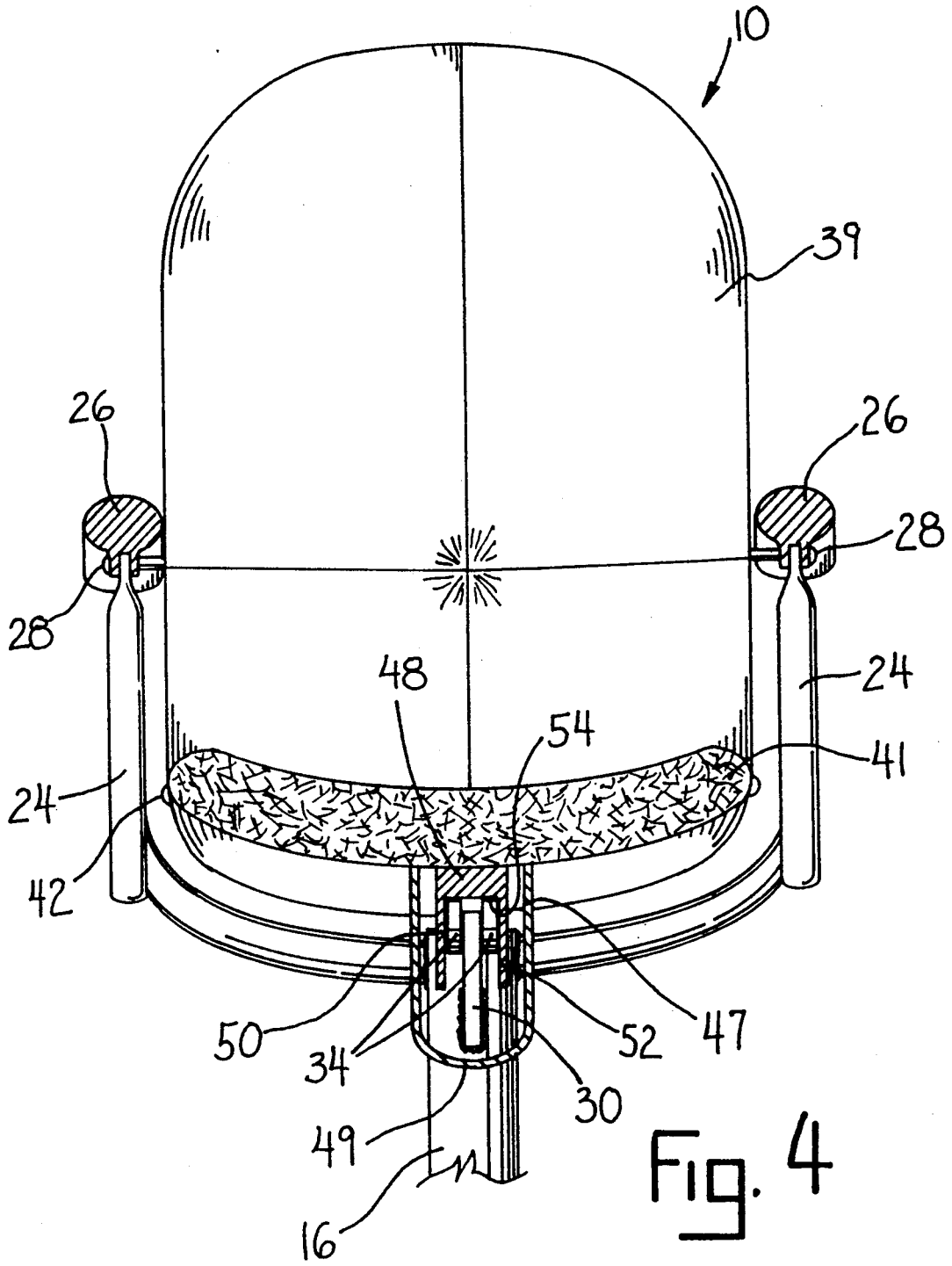
FIG. 4 is a sectional view taken along line 4—4 of FIG. 2.

Chair 10 is reclined by the user 56 shifting his/her weight rearwardly. Such movement causes a leverage motion on back support 38 in the direction of arrow 60 (FIG. 3). Due to the pivotal connection between back support 88 and chair support 20, and the pivotal connection between back support 38 and seat support 40, this movement of back support 38 causes the seat support 40 to move forwardly in the direction of arrow 58 (FIG. 8).

As the seat support 88 shifts forwardly, ramp 54 of plate 48 rides on rollers 84 to elevate the seat support a distance commensurate with the downward drop of back support 40. Therefore, the eye level of user 56 remains substantially unchanged during both the upright and reclined positions of chair 10.

The curvature of ramp 54 may be shaped so as to substantially match the direction of travel of back support 38 as shown by arrow 60 (see FIG. 3). The placement of ramp assembly 46 and roller arm 30 allows shifting of the chair 10 by users of various weight with the same degree of difficulty.

It is understood that the invention is not limited to the above-given details, but may be modified within the scope of the following claims.

We claim:

1. In a chair including a base, arm supports connected to said base at opposite sides of the base, a seat support and a back support pivotally interconnected for correlative movement thereof between an upright position and a reclined position, said seat support and back support connected to said base for relative movement therebetween, the improvement comprising a roller arm connected to and extending from said base from below said seat support, said seat support including a lower ramp means for contacting said roller arm wherein the seat support is raised vertically a corresponding distance to the distance of movement of said back support during said correlative movement of the seat and back supports, said arm supports having a terminal upper end above said seat support and below an upper edge of said back support, and means for pivotally connecting said back support to said arm support adjacent said terminal upper end wherein said seat support and back support may be pivoted between said upright and reclined positions by a user's shifting of weight.

2. The chair of claim 1 wherein said ramp means has a curved lower surface in contact with said roller arm, whereby eye level of a user seated in said chair remains substantially the same in both the upright position and the reclined position.

3. The chair of claim 1 and a roller connected to a terminal end of said roller arm, said ramp means contacting said roller.

4. The chair of claim 3 wherein said roller includes first and second wheels connected by an axle, said axle extending through said roller arm.

5. The chair of claim 3 wherein said ramp means includes a plate connected to said seat support, said plate having a curved lower surface whereby eye level of a user seated in said chair remains substantially constant.

6. The chair of claim 5 wherein said ramp means further includes second plates suspended vertically from said seat support at opposite sides of said first mentioned plate, said second plates constituting guide means for maintaining contact between said roller and said first plate curved lower surface.

7. The chair of claim 1 and further including a rod extending into said back support and connected to each arm support, said rod constituting means for limiting travel of said back support during movement towards the reclined position.

8. The chair of claim 6 and cover means connected to said seat support for shielding said ramp means, said cover means further including inturned opposing lower flanges underlying said rollers whereby lifting of seat support is prevented.

9. A chair comprising a base, arm supports connected to opposite sides of said base and extending above said base, a seat support shiftably supported atop said base, a back support, means for pivotally connecting said seat support and back support for relative movement therebetween, said base including a roller arm, said seat support including an inclined ramp shiftably supported atop said roller arm, means for pivotally connecting said back support to said arm supports adjacent said upper ends wherein said seat support and back support are shiftable relative to said base between an upright position and a reclined position by a user's shifting of weight.

* * * * *